US009259086B2

(12) United States Patent
Wong et al.

(10) Patent No.: US 9,259,086 B2
(45) Date of Patent: Feb. 16, 2016

(54) THREE-IN-ONE SOFA BED

(71) Applicant: Cheung Sing Wong, Hong Kong (CN)

(72) Inventors: Cheung Sing Wong, Hong Kong (CN); Yat Wong, Hong Kong (CN)

(73) Assignee: Cheung Sing Wong, Hong Kong (HK)

( * ) Notice: Subject to any disclaimer, the term of this patent is extended or adjusted under 35 U.S.C. 154(b) by 0 days.

(21) Appl. No.: 14/352,241

(22) PCT Filed: May 15, 2013

(86) PCT No.: PCT/CN2013/075655

§ 371 (c)(1),
(2) Date: Apr. 16, 2014

(87) PCT Pub. No.: WO2013/170753

PCT Pub. Date: Nov. 21, 2013

(65) Prior Publication Data

US 2014/0237717 A1 Aug. 28, 2014

(30) Foreign Application Priority Data

May 16, 2012 (CN) ..... 2012 1 0151078

(51) Int. Cl.

| | |
|---|---|
| ***A47B 83/02*** | (2006.01) |
| ***A47C 17/165*** | (2006.01) |
| ***A47B 85/04*** | (2006.01) |

(Continued)

(52) U.S. Cl.

CPC ..... *A47B 83/02* (2013.01); *A47B 85/04* (2013.01); *A47B 85/06* (2013.01); *A47C 17/16* (2013.01); *A47C 17/165* (2013.01); *A47C 17/37* (2013.01)

(58) Field of Classification Search

CPC ..... A47B 83/02; A47B 85/06; A47B 85/04; A47C 17/37; A47C 17/16; A47C 17/165; A47C 17/04; A47C 17/161; A47C 17/162; A47C 17/1753; A47C 17/52; A47C 17/62

See application file for complete search history.

(56) References Cited

U.S. PATENT DOCUMENTS

| | | | | |
|---|---|---|---|---|
| 3,726,535 | A * | 4/1973 | Longato | 280/659 |
| 4,506,927 | A * | 3/1985 | Lombardo | 297/118 |

(Continued)

FOREIGN PATENT DOCUMENTS

| | | | |
|---|---|---|---|
| CN | 2607884 | Y | 3/2004 |
| CN | 2875193 | Y | 3/2007 |

(Continued)

*Primary Examiner* — David E Sosnowski
*Assistant Examiner* — Amanda L Miller
(74) *Attorney, Agent, or Firm* — Birch, Stewart, Kolasch & Birch, LLP

(57) ABSTRACT

A three-in-one sofa bed including a bedstead assembly; a sofa cushion and sofa seat assembly fixedly connected to the bedstead assembly; a moveable coffee table; a mattress and mattress frame assembly a proximal section of which is pivotably connected to a rear section of the bedstead assembly to enable the mattress and mattress frame assembly to be rotated with respect to the bedstead assembly between a horizontal position and a vertical position. In the horizontal position, the mattress and mattress frame assembly straddles the sofa cushion and sofa seat assembly and the movable coffee table to form a bed. In the vertical position, the sofa cushion and sofa seat assembly and the movable coffee table are exposed. Balance weights are provided for the mattress frame between adjacent pulley grooves, to make torque in front of central axes of the pulleys be equal to that behind the central axes.

15 Claims, 6 Drawing Sheets

(51) Int. Cl.

| | |
|---|---|
| ***A47B 85/06*** | (2006.01) |
| ***A47C 17/16*** | (2006.01) |
| ***A47C 17/37*** | (2006.01) |

(56) References Cited

U.S. PATENT DOCUMENTS

| | | | | | |
|---|---|---|---|---|---|
| 4,692,952 | A * | 9/1987 | Dougher et al. | 5/37.1 |
| 4,885,813 | A * | 12/1989 | McNamara | 5/136 |
| 5,601,348 | A * | 2/1997 | Minkovski | 312/237 |
| 5,652,978 | A * | 8/1997 | Wiig | 5/144 |
| 6,341,392 | B1 | 1/2002 | Mäkinen | |
| 6,594,833 | B2 | 7/2003 | Timoshenko | |
| 7,231,675 | B1 * | 6/2007 | Rucinski et al. | 5/136 |
| 8,316,479 | B2 * | 11/2012 | Colombo | 5/8 |
| 8,850,637 | B1 * | 10/2014 | Burchett | 5/136 |
| 2001/0044960 | A1 * | 11/2001 | Schwalbe, Jr. | 5/136 |
| 2013/0019399 | A1 * | 1/2013 | Colombo | 5/2.1 |

FOREIGN PATENT DOCUMENTS

| | | | |
|---|---|---|---|
| CN | 201624371 | U | 11/2010 |
| GB | 2 179 849 | A | 3/1987 |

* cited by examiner

THREE-IN-ONE SOFA BED

CROSS-REFERENCE TO RELATED APPLICATIONS

This application is the National Phase of PCT/CN2013/075655 filed on May 15, 2013, which claims priority under 35 U.S.C §119(a) to Patent Application No. 201210151078.4 filed in China on May 16, 2012, all of which are hereby expressly incorporated by reference into the present application.

FIELD OF THE INVENTION

The present invention generally relates to furniture, and particularly to a three-in-one sofa bed which is convertible from a bed into a sofa and a coffee table.

BACKGROUND OF THE INVENTION

In modern life, house prices and rents increase rapidly, and thus low-income group would have to choose small-sized houses with a single bedroom. Normally, the usable floor area of such kind of house is only dozen to twenties square meters, and thus a bed would occupy a half of the area. It is inconvenient to walk around the bed. In this connection, a multi-purpose furniture is desirable, which could be converted to a bed for sleeping, or be converted to a sofa and a coffee table when not used for sleeping. Currently, the conversion operation for most of the existing furniture, such as sofa beds in the market is inconvenient. Meanwhile, such furniture generally is provided with springs or oil-pressure pumps, which needs a large occupation area and is generally very expensive.

SUMMARY OF THE INVENTION

The present invention aims to provide a three-in-one sofa bed, which has the function of a bed, a sofa and a coffee table, and has a simple structure. The present three-in-one sofa bed is convenient and comfortable for users, and the price thereof is moderate.

According to the present invention, three-in-one sofa bed is provided, which comprises: a bedstead assembly; a sofa cushion and sofa seat assembly fixedly connected to the bedstead assembly; a moveable coffee table; and a mattress and mattress frame assembly, in which a proximal section thereof is pivotably connected to a rear section of the bedstead assembly to enable the mattress and mattress frame assembly to be rotated with respect to the bedstead assembly between a horizontal position and a vertical position, wherein in the horizontal position, the mattress and mattress frame assembly straddles the sofa cushion and sofa seat assembly and the movable coffee table to form a bed for sleeping; while in the vertical position, the sofa cushion and sofa seat assembly and the movable coffee table are exposed.

In the above-mentioned three-in-one sofa bed, the mattress and mattress frame assembly is slidably connected to the bedstead assembly to enable the mattress and mattress frame assembly to be horizontally movable between a position departing from the bedstead assembly and a position retracting towards the bedstead assembly, in which the position where the mattress and mattress frame assembly retracts towards the bedstead assembly is the position where the mattress and mattress frame assembly is pivotably connected to the bedstead assembly.

In the above-mentioned three-in-one sofa bed, the bedstead assembly includes: two ground-mounted side plates on the left and right sides respective; a rear plate; an upper beam connecting upper ends of the two ground-mounted side plates; a curve-shaped movable bedstead back rest pivotably connected to the upper beam by virtue of hinges and movable between a stretch position when rotated rearwards to form a back rest and a position contacting the rear plate when rotated forwards; a pulley beam extending horizontally and fixed to a rear part of the ground-mounted side plates at a position slightly lower than the middle of the ground-mounted side plates; at least three pulley bracket assemblies provided systematically at both end sections and middle section of the pulley beam; and pulleys supported on the pulley bracket assemblies at an upper front position with respect to the pulley beam, in which the central axes of the pulleys extend in a left-to-right direction horizontally.

In the above-mentioned three-in-one sofa bed, the sofa cushion and sofa seat assembly includes a sponge cushion and a sofa seat, the sofa seat includes a top plate, two side plates, separators, a bottom plate and several drawers, in which the two side plates of the sofa seat are fixedly connected to the two ground-mounted side plates respectively, and the pulley beam is fixedly connected to the top plate of the sofa seat.

In the above-mentioned three-in-one sofa bed, the movable coffee tea includes a panel, two side plates, a middle stabilizing plate, a bottom plate, trolley plates and several trolleys.

In the above-mentioned three-in-one sofa bed, each of the pulley bracket assembly includes T-shaped frames formed by welding inclined ribbon irons and steel plates together, and pulleys rotatably provided at both sides of a front end of each ribbon iron of the T-shape frame by virtue of pins.

In the above-mentioned three-in-one sofa bed, the mattress and mattress frame assembly includes a mattress frame and a mattress placed on the mattress frame; the mattress frame includes a frame; at least three pulley grooves are provided on the bottom of the front part of the frame in the middle portion and left and right sides respectively and extend in a front-to-back direction; the pulley grooves are used to receive the corresponding pulleys to enable to slide in the front-to-back direction; an L-shaped pulley groove terminal is fixed to a rear part of each pulley groove; a horizontal bottom edge of each pulley groove terminal is provided with an elongated inlet aperture for the ribbon iron of each T-shape frame; when the pulley groove terminals slide forward, vertical edges and the horizontal bottom edges of the pulley groove terminals press on the pulleys; a limit stop is provided at the front end of each pulley groove for prevent the pulley grooves being pulled rearwards excessively.

In the above-mentioned three-in-one sofa bed, the length of the pulley grooves is not larger than the distance between the central axes of the pulleys and the ground, and is not larger than the distance between the central axes of the pulleys and the rear plate of the bedstead assembly.

In the above-mentioned three-in-one sofa bed, the frame of the mattress frame is provided with a sofa back cushion at its bottom parts behind the pulley groove terminal, while is provided with balance weights at the parts in front of the pulley groove terminals and between two adjacent pulley grooves; the balance weights are provided in the manner that when the pulley grooves are in a horizontal position where the pulley groove terminals press on the pulleys, the torque near a center of gravity of the combination of the mattress, mattress frame, pulley grooves, balance weights in front of the central axes of the pulleys is substantive equal to the torque near a center of gravity of the combination of the mattress, mattress frame, sofa back cushion behind the central axes.

In the above-mentioned three-in-one sofa bed, the frame of the mattress frame is made of aluminum alloy profile, steel profile or rectangle steel tube by means of welding.

In the above-mentioned three-in-one sofa bed, the pulley grooves are made of aluminum alloy profile or steel channel, or are manufactured by stamping steel sheet, and are fixed or welded to the frame.

The three-in-one sofa bed according to the present invention has a simple structure and moderate price, and is convenient, comfortable and safe for users.

BRIEF DESCRIPTION OF THE DRAWINGS

The basic structure of the present invention will be described with reference to the accompanying drawings, in which.

DETAILED DESCRIPTION OF THE INVENTION

One embodiment of the three-in-one sofa bed of the present invention will be described as an example of the present invention, with reference to the accompanying drawings. It should be understood that the present invention should not be limited thereto.

Figure 1:
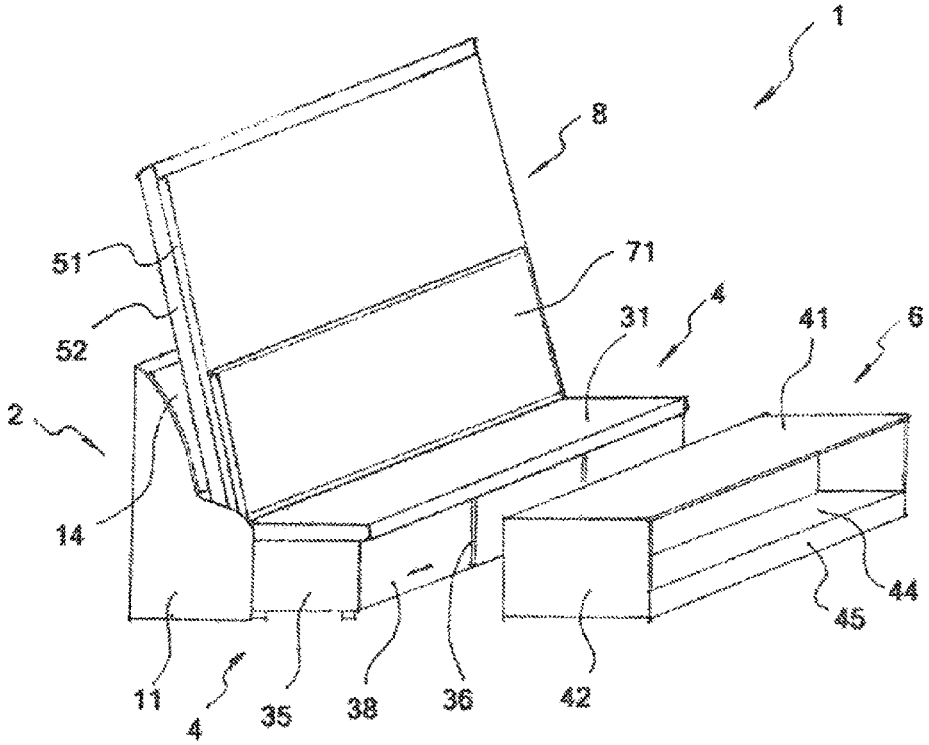
FIG. 1 is a schematic view of the structure of the three-in-one sofa bed according to the present invention, illustrating its configuration as a sofa and a coffee table.
Figure 2:
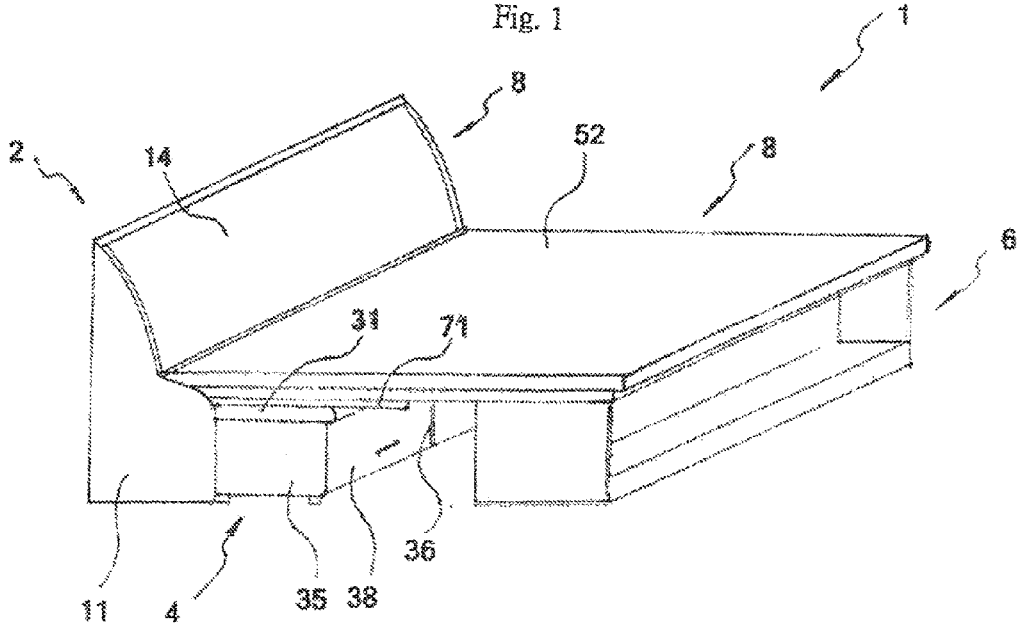
FIG. 2 is a schematic view of the structure of the three-in-one sofa bed according to the present invention, illustrating its configuration as a bed.
Figure 3:
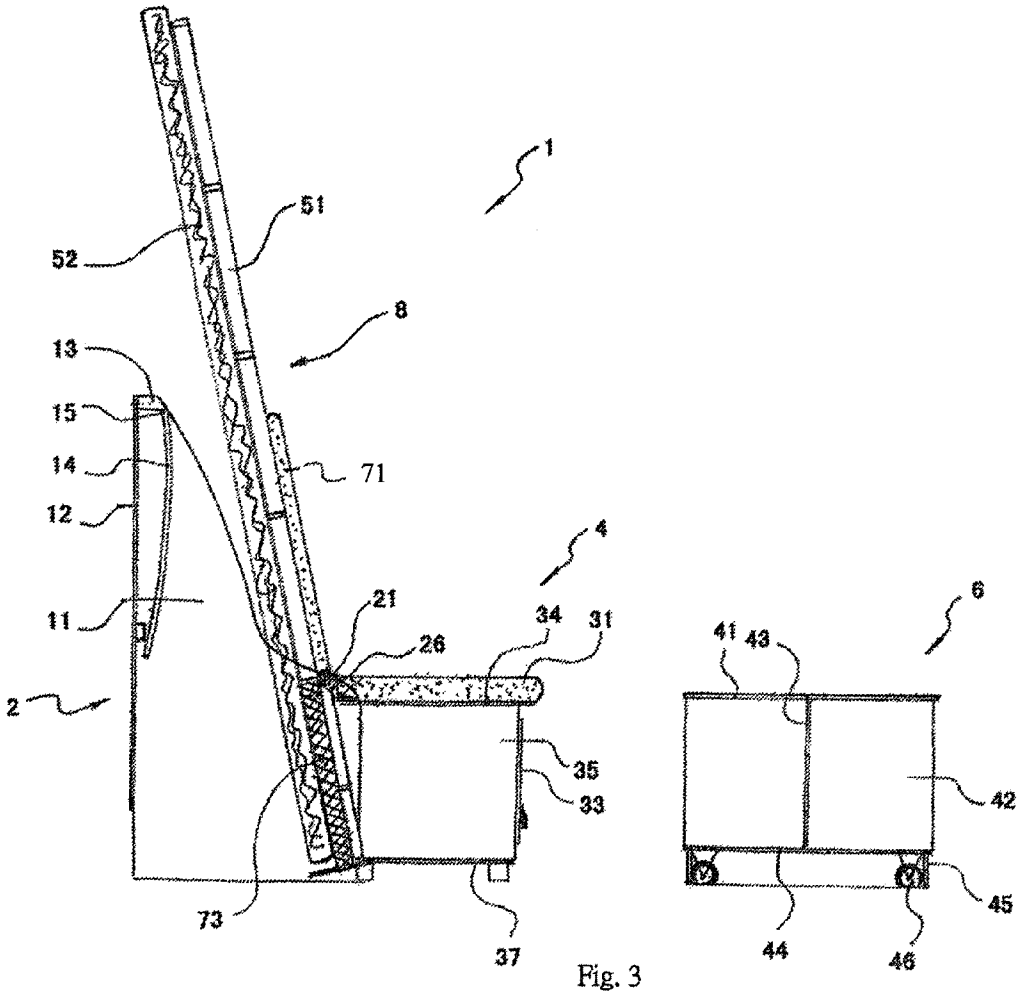
FIG. 3 is a side cross-sectional view of the three-in-one sofa bed shown in FIG. 1.
Figure 4:
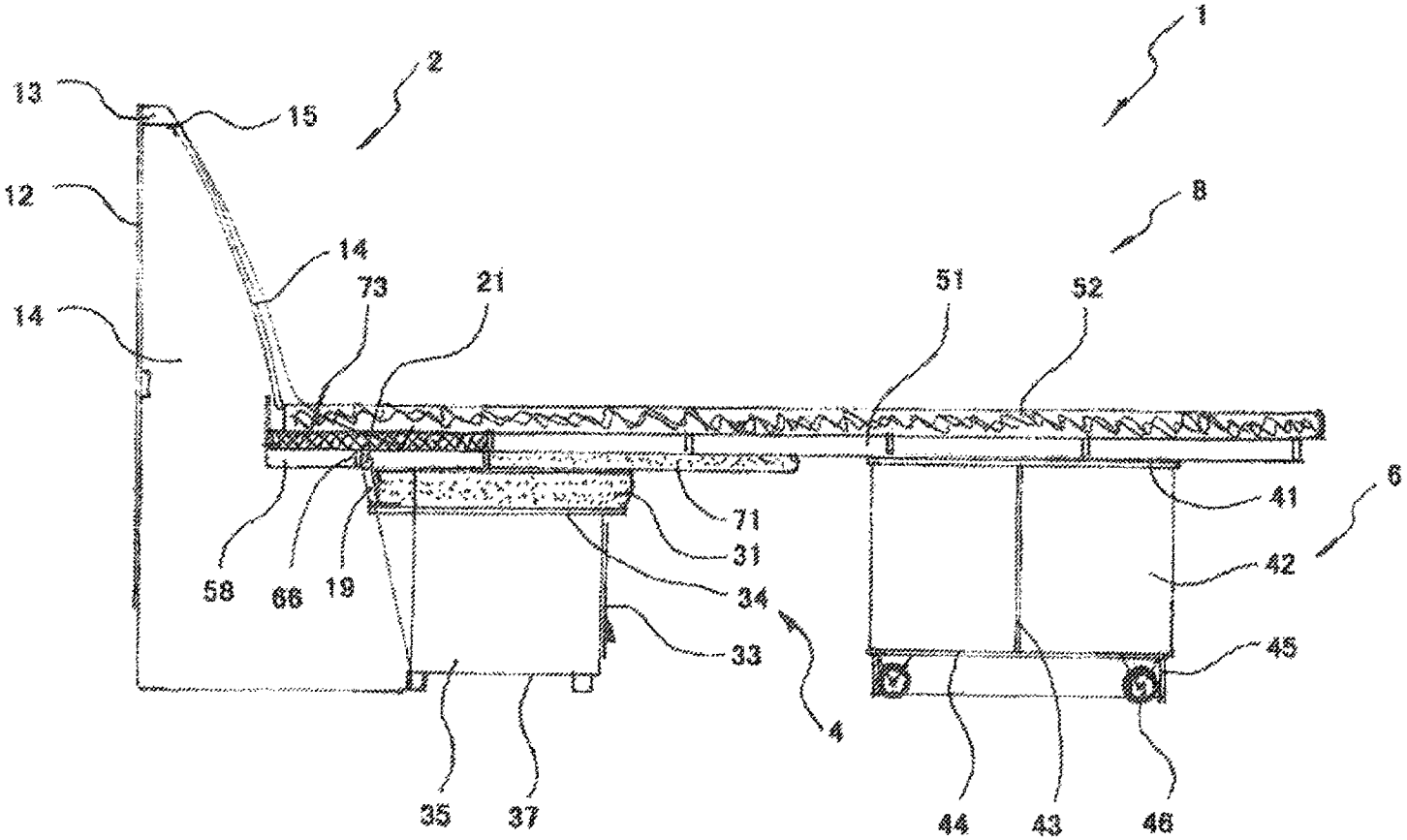
FIG. 4 is a side cross-sectional view of the three-in-one sofa bed shown in FIG. 2, illustrating the status in which a mattress and mattress frame assembly is in a position departing from a bedstead assembly.
Figure 5:
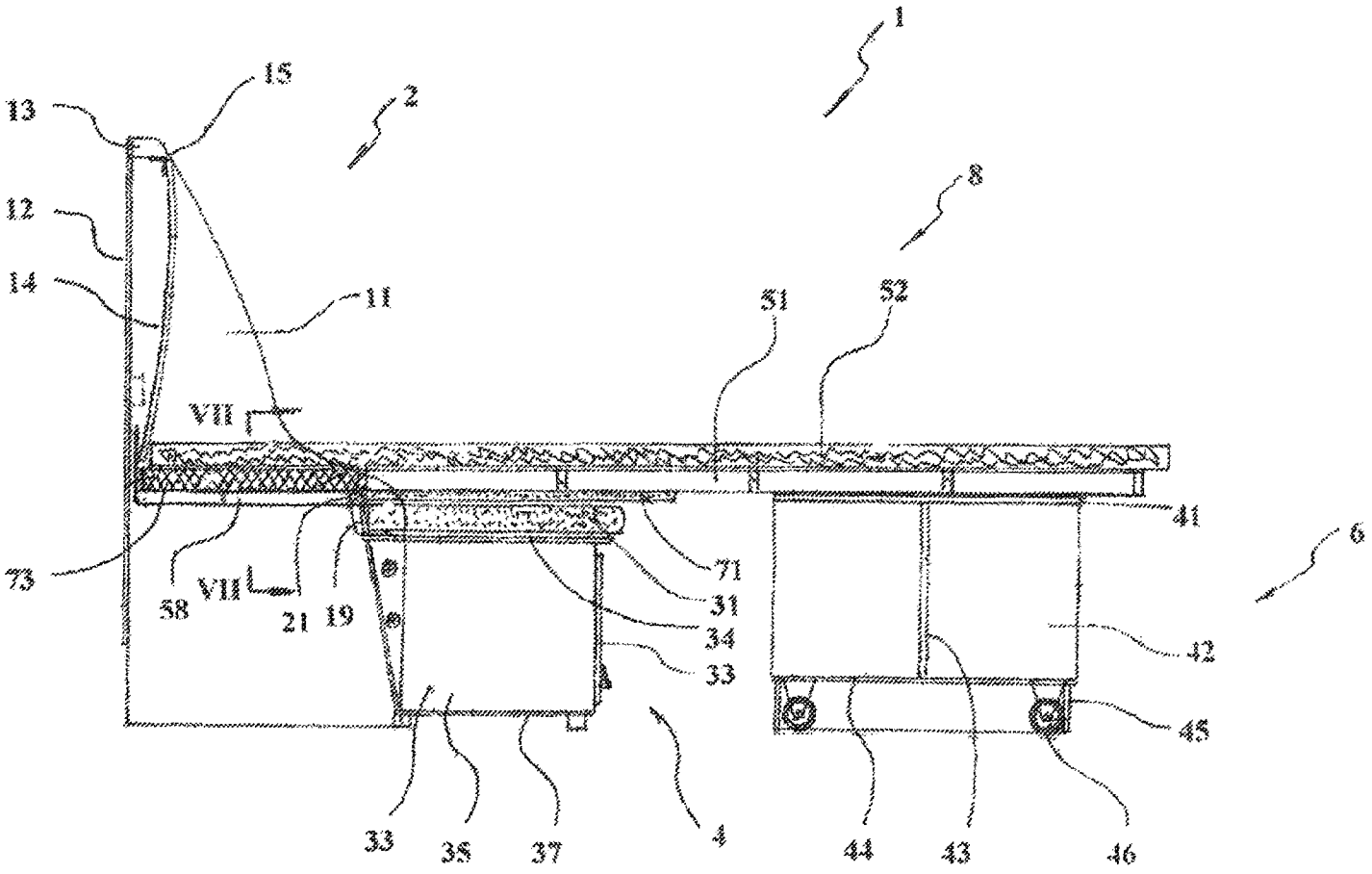
FIG. 5 is a side cross-sectional view of the three-in-one sofa bed shown in FIG. 2, illustrating the status in which the mattress and mattress frame assembly is in a position retracting towards the bedstead assembly, where the mattress and mattress frame assembly is pivotably connected to the bedstead assembly.

As shown in FIGS. 1-5, the present three-in-one sofa bed 1 includes a bedstead assembly 2, a sofa cushion and sofa seat assembly 4 fixedly connected to the bedstead assembly 2, a movable coffee table 6, and a mattress and mattress frame assembly 8. A proximal end of the mattress and mattress frame assembly 8 is pivotably connected to a distal end of the bedstead assembly 2, to enable to be pivoted with respect to the bedstead assembly 2 between a horizontal position and a vertical position. As shown in FIGS. 2, 4 and 5, in the horizontal position, the mattress and mattress frame assembly straddles the sofa cushion and sofa seat assembly 4 and the movable coffee table 6 to form a bed for sleeping. As shown in FIGS. 1 and 3, in the vertical position, the sofa cushion and sofa seat assembly 4 and the movable coffee table 6 are exposed. Furthermore, the mattress and mattress frame assembly 8 is slidably connected to the bedstead assembly 2, to enable the mattress and mattress frame assembly 8 to be horizontally movable between a position departing from the bedstead assembly 2 (as shown in FIG. 4) and a position retracting towards the bedstead assembly 2 (as shown in FIG. 5). The position where the mattress and mattress frame assembly 8 retracts towards the bedstead assembly 2 is the position where the mattress and mattress frame assembly 8 is pivotably connected to the bedstead assembly (as shown in FIG. 3).

Hereinafter, the terms "front" refers to the direction towards the bedstead assembly 2, "rear" refers to the direction away from the bedstead assembly 2, "left" refers to the left side when viewed towards the bedstead assembly 2, and "right" refers to the right side when viewed towards the bedstead assembly 2. However, it should be understood that those terms are for illustration purpose only, and should not be construed as limitation to the protective scope of the present invention.

Figure 6:
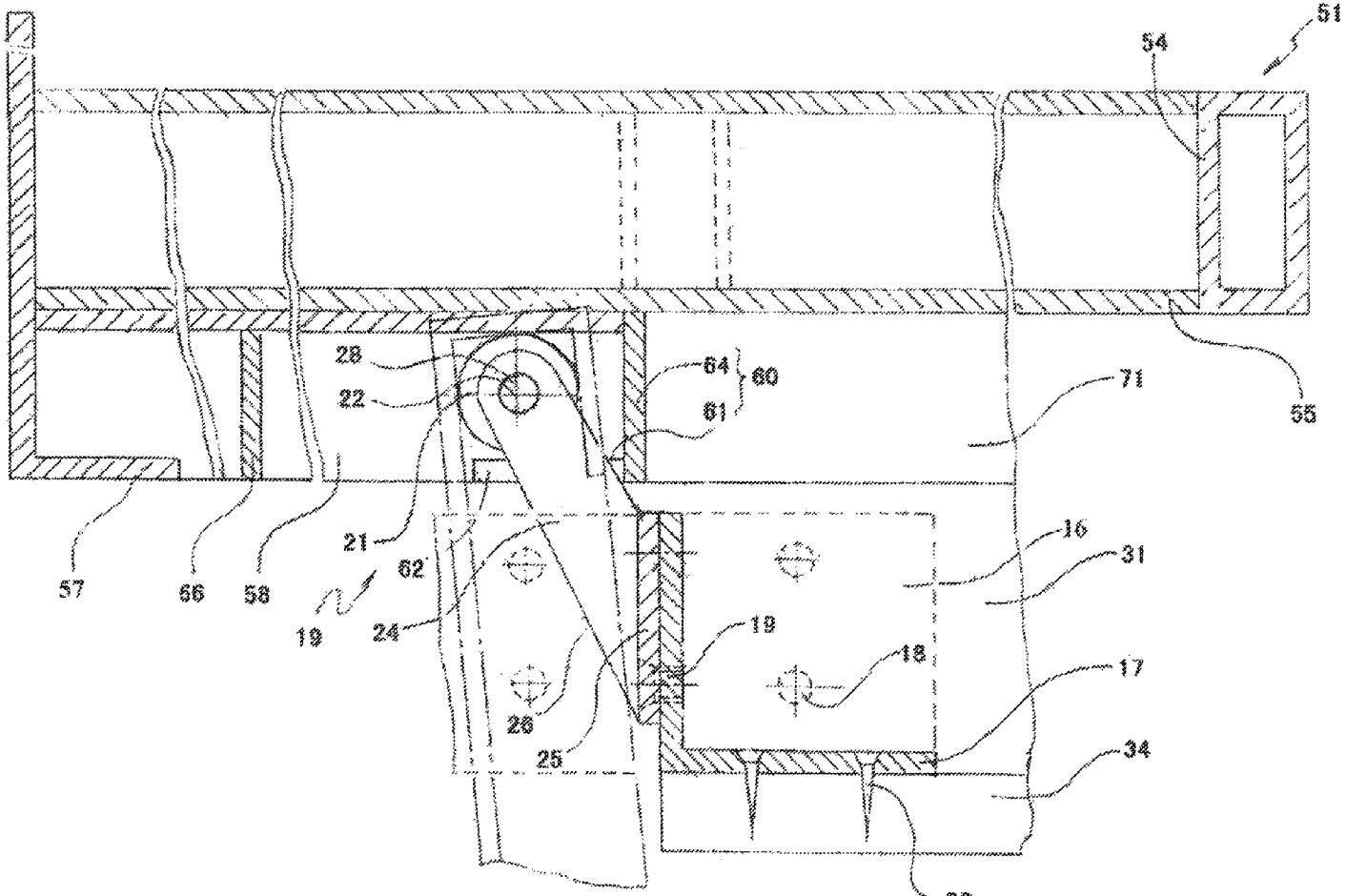
FIG. 6 is a partially enlarged cross-sectional view of a coupling structure of a mattress frame and a pulley bracket assembly as shown in FIG. 5.
Figure 7:
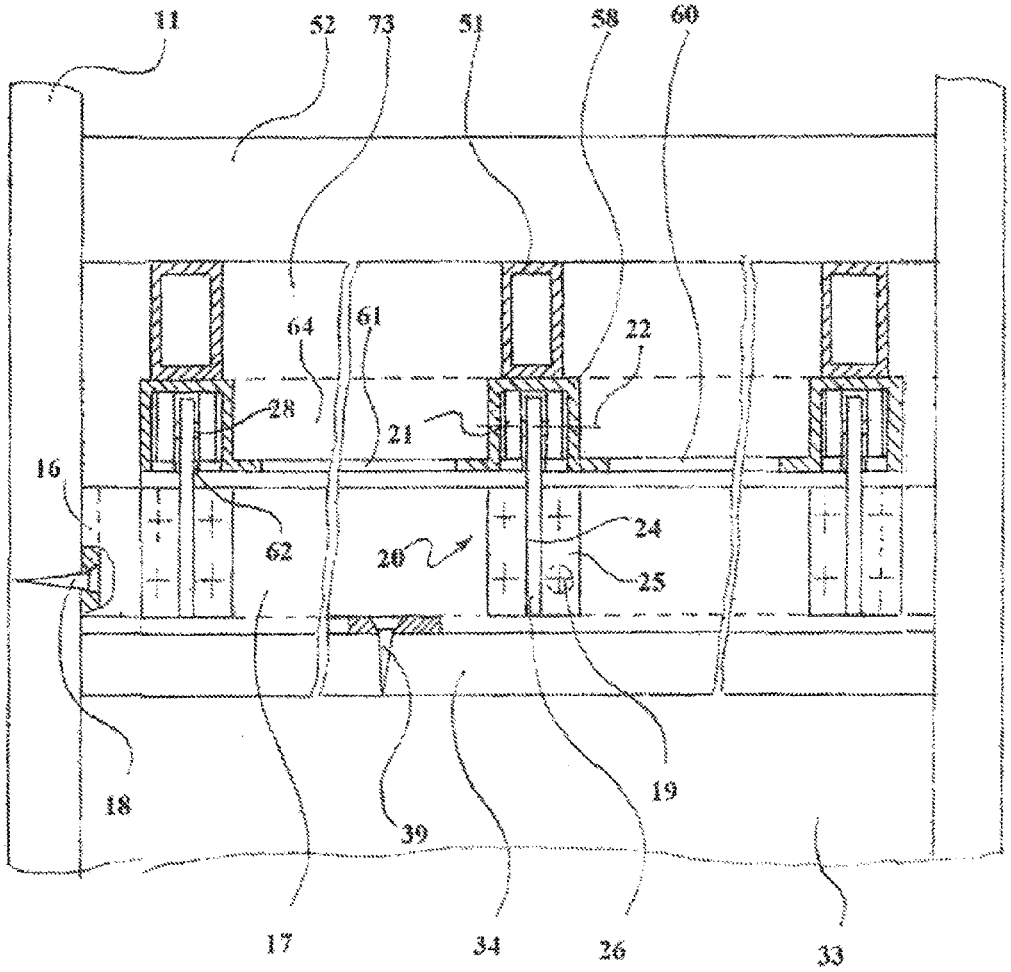
FIG. 7 is a partially enlarged cross-sectional view of the part cut along the line VII-VII of FIG. 5, illustrating a coupling structure of the mattress frame and the pulley bracket assembly.

The bedstead assembly 2 includes two ground-mounted side plates 11 on the left and right sides respective, and a rear plate 12. An upper beam 13 connects upper ends of the two ground-mounted side plates 11. A movable bedstead back rest 14 is pivotably connected to the upper beam 13 by virtue of hinges 15, which is in a curve shape, and is movable between a stretch position when rotated towards the rear and a position contacting the rear plate 12 when rotated towards the front. The movable bedstead back rest could be used as a back rest at the stretch position after being rotated towards the rear along with the moving of the mattress and mattress frame assembly 8 away from the bedstead assembly 2 (as shown in FIG. 4). The movable bedstead back rest could be retracted into the bedstead assembly 2 at the position contacting the rear plate 12 after being rotated towards the front along with the retracting of the mattress and mattress frame assembly 8 towards the bedstead assembly 2, to enable to reduce the occupation area of the mattress and mattress frame assembly 8 (as shown in FIG. 5). As shown in FIGS. 6 and 7, a pulley beam 17 extends horizontally, and is fixed to a rear part of the ground-mounted side plates 11 through support members, such as ribbon irons, at its opposite ends by virtue of screws 18. The position where the pulley beam is fixed to the ground-mounted side plates 11 is slightly lower than the middle of the ground-mounted side plates 11. At least three pulley bracket assemblies 20 are provided systematically at the both end sections and middle section of the pulley beam 17 by means of screws 19, and pulleys 21 supported on the pulley bracket assemblies 20 are provided at an upper front position with respect to the pulley beam 17. Central axes 22 of the pulleys 21 extend in left-to-right direction horizontally. In the present embodiment, it should be understood that more than 3 pulley bracket assemblies 20 may be adapted according to the width and weight of the bed. Each pulley bracket assembly 20 could include T-shaped frames 26 formed by welding inclined ribbon irons 24 and steel plates 25 together, and the pulleys 21 rotatably provided at both sides of a front end of each ribbon iron 24 of the T-shape frame 26 by virtue of pins 28.

The sofa cushion and sofa seat assembly 4 includes a sponge cushion 21 and a sofa seat 33. The sofa seat 33 includes a top plate 34, two side plates 35, separators 36, a bottom plate 37 and several drawers 38. The two side plates 35 of the sofa seat 33 are fixedly connected to the two ground-mounted side plates 11 respectively, and the pulley beam 17 is fixedly connected to the top plate 34 of the sofa seat 33 by virtue of screws 39.

The movable coffee table 6 includes a panel 41, two side plates 42, a middle stabilizing plate 43, a bottom plate 44, trolley plates 45 and several trolleys 46.

The mattress and mattress frame assembly 8 includes a mattress frame 51 and a mattress 52 placed on the mattress frame. The mattress frame 51 includes a frame 55 made of aluminum alloy profile, steel profile or rectangle steel tube 54 by means of welding. The most front end of the frame 55 could be L-shaped aluminum alloy profile or L-shaped angle steel 57, to enable to hook up the movable bedstead back rest 14. Steel sheets (not shown in figures) could be interlaced with each other and fixed to the rectangle steel tube 54 to form a bed plank. Furthermore, the space in the rectangle steel tube 54 could be filled with foam rubber (not shown in figures) to keep warm.

As shown in FIGS. 6 and 7, at least three pulley grooves 58 could be provided on the bottom of the front part of the frame 55 in the middle portion and left and right sides respectively, and extend in a front-to-back direction. The pulley grooves 58 are used to receive the corresponding pulleys 21, to enable to slide in the front-to-back direction. The pulley grooves 58 could be made of aluminum alloy profile or steel channel, or be manufactured by stamping steel sheet. The pulley grooves 58 are fixed or welded to the frame 55. As shown in the figures, in the present embodiment, there are three pulley grooves 58. However, it should be understood that more than three pulley grooves 58 could be adapted according to the width and weight of the bed. An L-shaped pulley groove terminal 60 could be fixed to a rear part of each pulley groove 58. A horizontal bottom edge 61 of each pulley groove terminal 60 is provided with an elongated inlet aperture 62 for the ribbon iron 24 of each T-shape frame 26. When the pulley groove terminals 60 slide forward, vertical edges 64 and the horizontal bottom edges 61 of the pulley groove terminals press on the pulleys 21, and thus the movable bedstead back rest 14 is in the position contacting the rear plate 12 after rotated rearwards, as shown in FIG. 5. In this connection, the mattress and mattress frame assembly 8 is retracted towards the bedstead assembly 2, and thus the occupation area of the bed could be reduced. In this position, the mattress and mattress frame assembly 8 is ready to be pivoted and lifted. Furthermore, a limit stop 66 could be provided at the front end of each pulley groove 58, to prevent the pulley grooves being pulled rearwards excessively. In this position, the bedstead assembly 14 could be used as a back rest after being rotated outwards, as shown in FIG. 4.

The frame 55 of the mattress frame 51 is provided with a sofa back cushion 71 at its bottom parts behind the pulley groove terminal 60, while is provided with balance weights 73 at the parts in front of the pulley groove terminals 60 and between two adjacent pulley grooves 58. The balance weights could be made of concrete or iron. The balance weights 73 are provided in the manner that when the pulley grooves 58 are in a horizontal position where the pulley groove terminals 60 press on the pulleys 21, the torque near the center of gravity (not shown in the figures) of the combination of the mattress 52, mattress frame 51, pulley grooves 58, balance weights 73, etc. in front of the central axes 22 of the pulleys 21 is almost equal to the torque near the center of gravity (not shown in the figures) of the combination of the mattress 52, mattress frame 51, sofa back cushion 71, etc. behind the central axes 22. Thus, when the bed needs to be converted to sofa and coffee table, it is only necessary to slightly push the mattress 52 towards the bedstead assembly 2 and then lift it, to enable the pulley grooves 58 to be rotated about the pulleys 21 and then erect the mattress and mattress frame assembly 8. Comparing to the reduction of the torque near the center of gravity of the combination of the mattress 52, mattress frame 51, pulley grooves 58, balance weights 73, etc. in front of the central axes 22, the reduction of the torque near the center of gravity of the combination of the mattress 52, mattress frame 51, sofa back cushion 71, etc. behind the central axes 22 of the pulleys 21 is much larger, which makes the mattress and mattress frame assembly 8 to lose its balance, and thus automatically rotate to press against the wall. Thus, the convert operation of the present invention is very convenient, and could overcome the shortcomings in conventional beds of spring type, air-pressure type and oil-pressure type. The length of the pulley grooves is not larger than the distance between the central axes 22 and the ground, and is not larger than the distance between the central axes 22 and the rear plate 12 of the bedstead assembly 2. In this connection, after the mattress is erected, the lowest part of the mattress is at about 1 cm above from the ground.

It is to be understood that in the description of the present invention the term "trolley" refers to wheels or casters and the term "pulley" refers to rollers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A three-in-one sofa bed comprising:

a bedstead assembly;

a sofa cushion and sofa seat assembly fixedly connected to the bedstead assembly;

a moveable coffee table; and a mattress and mattress frame assembly, in which a proximal section thereof is pivotably connected to a rear section of the bedstead assembly to enable the mattress and mattress frame assembly to be rotated with respect to the bedstead assembly between a horizontal position and a vertical position, wherein in the horizontal position, the mattress and mattress frame assembly straddles the sofa cushion and sofa seat assembly and the movable coffee table to form a bed for sleeping; while in the vertical position, the sofa cushion and sofa seat assembly and the movable coffee table are exposed;

said mattress and mattress frame assembly being slidably connected to the bedstead assembly to enable the mattress and mattress frame assembly to be horizontally movable between a position departing from the bedstead assembly and a position retracting towards the bedstead assembly, in which the position where the mattress and mattress frame assembly retracts towards the bedstead assembly is a position where the mattress and mattress frame assembly is pivotably connected to the bedstead assembly;

wherein the bedstead assembly includes:

two ground-mounted side plates on a left side and a right side, respectively;

a rear plate;

an upper beam connecting upper ends of the two ground-mounted side plates;

a curve-shaped movable bedstead back rest pivotably connected to the upper beam by virtue of hinges and movable between a stretch position when rotated rearwards to form a back rest and a position contacting the rear plate when rotated forwards;

a pulley beam extending horizontally and fixed to a rear part of each of the ground-mounted side plates at a position slightly lower than the middle of each of the ground-mounted side plates respectively;

at least three pulley bracket assemblies provided systematically at end sections and a middle section of the pulley beam; and pulleys supported on the pulley bracket assemblies at an upper front position with respect to the pulley beam, in which central axes of the pulleys extend in a left-to-right direction horizontally;

said sofa cushion and sofa seat assembly includes a sponge cushion and a sofa seat, the sofa seat includes a top plate, two side plates, separators, a bottom plate and several drawers, in which the two side plates of the sofa seat are fixedly connected to the two ground-mounted side plates respectively, and the pulley beam is fixedly connected to the top plate of the sofa seat.

2. The three-in-one sofa bed according to claim 1, wherein the movable coffee table includes a panel, two side plates, a middle stabilizing plate, a bottom plate, trolley plates and several trolleys.

3. The three-in-one sofa bed according to claim 1, wherein each of the pulley bracket assembly includes T-shaped frames formed by welding inclined ribbon irons and steel plates together, and pulleys rotatably provided at both sides of a front end of each ribbon iron of the T-shape frame by virtue of pins.

4. The three-in-one sofa bed according to claim 3, wherein the mattress and mattress frame assembly includes a mattress frame and a mattress placed on the mattress frame; the mattress frame includes a frame; at least three pulley grooves are provided on a bottom of a front part of the frame in a middle portion and left and right sides respectively and extend in a front-to-back direction; the pulley grooves are used to receive corresponding pulleys to enable the frame to slide in the front-to-back direction; an L-shaped pulley groove terminal is fixed to a rear part of each pulley groove; a horizontal bottom edge of each pulley groove terminal is provided with an elongated inlet aperture for the ribbon iron of each T-shaped frame; when the pulley groove terminals slide forward, vertical edges and the horizontal bottom edges of the pulley groove terminals press on the pulleys; a limit stop is provided at a front end of each pulley groove for preventing the pulley grooves from being pulled rearwards excessively.

5. The three-in-one sofa bed according to claim 4, wherein a length of each of the pulley grooves is not larger than a distance between the central axes of the pulleys and the ground, and is not larger than a distance between the central axes of the pulleys and the rear plate of the bedstead assembly.

6. The three-in-one sofa bed according to claim 4, wherein the frame of the mattress frame is provided with a sofa back cushion behind the pulley groove terminal, while the frame is provided with balance weights positioned in front of the pulley groove terminals and between two adjacent pulley grooves; the balance weights are provided wherein when the pulley grooves are in a horizontal position where the pulley groove terminals press on the pulleys, a torque near a center of gravity of the combination of the mattress, mattress frame, pulley grooves, and balance weights in front of the central axes of the pulleys is substantially equal to a torque near a center of gravity of the combination of the mattress, mattress frame, and sofa back cushion behind the central axes.

7. The three-in-one sofa bed according to claim 4, wherein the frame of the mattress frame is made of aluminum alloy profile, steel profile, or rectangle steel tube by means of welding.

8. The three-in-one sofa bed according to claim 7, wherein the pulley grooves are made of aluminum alloy profile or steel channel, or are manufactured by stamping steel sheet, and are fixed or welded to the frame.

9. A three-in-one sofa bed comprising:

a bedstead assembly;

a sofa cushion and sofa seat assembly fixedly connected to the bedstead assembly;

a moveable coffee table; and a mattress and mattress frame assembly, in which a proximal section thereof is pivotably connected to a rear section of the bedstead assembly to enable the mattress and mattress frame assembly to be rotated with respect to the bedstead assembly between a horizontal position and a vertical position, wherein in the horizontal position, the mattress and mattress frame assembly straddles the sofa cushion and sofa seat assembly and the movable coffee table to form a bed for sleeping; while in the vertical position, the sofa cushion and sofa seat assembly and the movable coffee table are exposed;

said mattress and mattress frame assembly being slidably connected to the bedstead assembly to enable the mattress and mattress frame assembly to be horizontally movable between a position departing from the bedstead assembly and a position retracting towards the bedstead assembly, in which the position where the mattress and mattress frame assembly retracts towards the bedstead assembly is a position where the mattress and mattress frame assembly is pivotably connected to the bedstead assembly;

wherein the bedstead assembly includes:

two ground-mounted side plates on a left side and a right side, respectively;

a rear plate;

an upper beam connecting upper ends of the two ground-mounted side plates;

a curve-shaped movable bedstead back rest pivotably connected to the upper beam by virtue of hinges and movable between a stretch position when rotated rearwards to form a back rest and a position contacting the rear plate when rotated forwards;

a pulley beam extending horizontally and fixed to a rear part of each of the ground-mounted side plates at a position slightly lower than the middle of each of the ground-mounted side plates respectively;

at least three pulley bracket assemblies provided systematically at end sections and a middle section of the pulley beam; and pulleys supported on the pulley bracket assemblies at an upper front position with respect to the pulley beam, in which central axes of the pulleys extend in a left-to-right direction horizontally;

wherein each of the pulley bracket assembly includes T-shaped frames formed by welding inclined ribbon irons and steel plates together, and pulleys rotatably provided at both sides of a front end of each ribbon iron of the T-shaped frame by virtue of pins.

10. The three-in-one sofa bed according to claim 9, wherein the mattress and mattress frame assembly includes a mattress frame and a mattress placed on the mattress frame; the mattress frame includes a frame; at least three pulley grooves are provided on a bottom of a front part of the frame in a middle portion and left and right sides respectively and extend in a front-to-back direction; the pulley grooves are used to receive corresponding pulleys to enable the frame to slide in the front-to-back direction; an L-shaped pulley groove terminal is fixed to a rear part of each pulley groove; a horizontal bottom edge of each pulley groove terminal is provided with an elongated inlet aperture for the ribbon iron of each T-shaped frame; when the pulley groove terminals slide forward, vertical edges and the horizontal bottom edges of the pulley groove terminals press on the pulleys; a limit stop is provided at a front end of each pulley groove for preventing the pulley grooves from being pulled rearwards excessively.

11. The three-in-one sofa bed according to claim 10, wherein the length of the pulley grooves is not larger than a distance between the central axes of the pulleys and the ground, and is not larger than a distance between the central axes of the pulleys and the rear plate of the bedstead assembly.

12. The three-in-one sofa bed according to claim 10, wherein the frame of the mattress frame is provided with a sofa back cushion behind the pulley groove terminal, while the frame is provided with balance weights positioned in front of the pulley groove terminals and between two adjacent pulley grooves; the balance weights are provided wherein when the pulley grooves are in a horizontal position where the pulley groove terminals press on the pulleys, a torque near a center of gravity of the combination of the mattress, mattress frame, pulley grooves, and balance weights in front of the central axes of the pulleys is substantially equal to a torque near a center of gravity of the combination of the mattress, mattress frame, and sofa back cushion behind the central axes.

13. The three-in-one sofa bed according to claim 10, wherein the frame of the mattress frame is made of aluminum alloy profile, steel profile, or rectangle steel tube by means of welding.

14. The three-in-one sofa bed according to claim 13, wherein the pulley grooves are made of aluminum alloy profile or steel channel, or are manufactured by stamping steel sheet, and are fixed or welded to the frame.

15. The three-in-one sofa bed according to claim 9, wherein the movable coffee table includes a panel, two side plates, a middle stabilizing plate, a bottom plate, trolley plates and several trolleys.

* * * * *